US010808506B2

(12) United States Patent
Riisem et al.

(10) Patent No.: US 10,808,506 B2
(45) Date of Patent: Oct. 20, 2020

(54) SAND CONTROL SYSTEM AND METHODOLOGY

(71) Applicant: SCHLUMBERGER TECHNOLOGY CORPORATION, Sugar Land, TX (US)

(72) Inventors: Edvin E. Riisem, Sandnes (NO); Pavel Petukhov, Stavanger (NO); Andrzej Tunkiel, Sandnes (NO); Aurelien Mainy, Figgjo (NO); Terje Moen, Sandnes (NO); Michael D. Langlais, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 146 days.

(21) Appl. No.: 14/340,682

(22) Filed: Jul. 25, 2014

(65) Prior Publication Data

US 2015/0027700 A1 Jan. 29, 2015

Related U.S. Application Data

(60) Provisional application No. 61/858,405, filed on Jul. 25, 2013, provisional application No. 61/985,289, filed on Apr. 28, 2014.

(51) Int. Cl.
*E21B 43/04* (2006.01)
*E21B 43/08* (2006.01)

(52) U.S. Cl.
CPC ..... *E21B 43/04* (2013.01); *E21B 43/08* (2013.01)

(58) Field of Classification Search
CPC ..... E21B 43/04; E21B 43/08; E21B 43/088
See application file for complete search history.

(56) References Cited

U.S. PATENT DOCUMENTS 4,423,773 A * 1/1984 Stout ..... E21B 34/063 166/317
4,428,428 A 1/1984 Smyrl et al.
(Continued)

FOREIGN PATENT DOCUMENTS

RU 2118746 C1 9/1998
WO 2012135587 A2 10/2012
(Continued)

OTHER PUBLICATIONS

PCT/US2014/048139, International Search Report and Written Opinion, dated Nov. 13, 2014, 15 pgs.
(Continued)

*Primary Examiner* — D. Andrews
*Assistant Examiner* — Manuel C Portocarrero
(74) *Attorney, Agent, or Firm* — Kelly McKinney

(57) ABSTRACT

A technique facilitates a well operation employing at least one dehydration tube. The at least one dehydration tube is located along an exterior of a plurality of screen assemblies deployed in a wellbore and is fluidly coupled to a base pipe of at least one of the screen assemblies. The fluid coupling provides fluid access to the base pipe through a base pipe opening. Fluid flow along the at least one dehydration tube is controlled with a flow control mechanism. Additionally, an inflow of fluid from an exterior to an interior of select screen assemblies is separately controlled with an inflow control device associated with each select screen assembly.

21 Claims, 6 Drawing Sheets

(56) References Cited

U.S. PATENT DOCUMENTS 4,733,723 A * 3/1988 Callegari, Sr. ..... E21B 34/12 166/278
5,113,935 A 5/1992 Jones et al.
5,341,880 A 8/1994 Thorstensen et al.
5,917,489 A 6/1999 Thurlow et al.
6,041,803 A 3/2000 De Almeida et al.
6,047,310 A 4/2000 Kamakura et al.
6,176,307 B1 1/2001 Danos et al.
6,371,210 B1 4/2002 Bode et al.
6,427,164 B1 7/2002 Reilly
6,505,682 B2 1/2003 Brockman
6,561,732 B1 5/2003 Bloomfield et al.
6,622,794 B2 9/2003 Zisk, Jr.
6,654,787 B1 11/2003 Aronson et al.
6,679,949 B2 1/2004 De Almeida
6,681,854 B2 1/2004 Danos
6,691,156 B1 2/2004 Drummond et al.
6,716,268 B2 4/2004 Molyneux et al.
6,721,785 B1 4/2004 Raghunandan
6,745,843 B2 6/2004 Johnson et al.
6,832,246 B1 12/2004 Quine
6,868,498 B1 3/2005 Katsikas
7,100,686 B2 9/2006 Wittrisch
7,185,706 B2 3/2007 Freyer
7,290,606 B2 11/2007 Coronado et al.
7,409,999 B2 8/2008 Henriksen et al.
7,523,787 B2 4/2009 Richards et al.
7,559,375 B2 7/2009 Dybevik et al.
7,708,068 B2 5/2010 Hailey, Jr.
7,789,145 B2 9/2010 Patel
7,814,973 B2 * 10/2010 Dusterhoft ..... E21B 47/01 166/227
7,828,067 B2 11/2010 Scott et al.
7,866,383 B2 1/2011 Dusterhoft et al.
7,958,939 B2 6/2011 Talley
7,971,642 B2 7/2011 Yeh et al.
7,984,760 B2 7/2011 Haeberle et al.
7,987,909 B2 8/2011 Pineda et al.
8,011,438 B2 9/2011 Edwards et al.
8,127,831 B2 3/2012 Haeberle et al.
8,146,662 B2 4/2012 Shoemate
8,256,510 B2 9/2012 Holderman et al.
8,453,746 B2 1/2013 Hailey, Jr. et al.
8,485,265 B2 7/2013 Marya et al.
8,622,125 B2 1/2014 Weirich et al.
8,919,435 B2 12/2014 Greci et al.
9,273,537 B2 3/2016 Riisem
9,771,780 B2 9/2017 Langlais
10,100,606 B2 10/2018 Langlais
10,113,390 B2 10/2018 Langlais et al.
10,227,849 B2 3/2019 Huh et al.
2001/0049745 A1 12/2001 Schoeffler
2001/0051991 A1 12/2001 Beyda et al.
2002/0079099 A1 6/2002 Hurst et al.
2002/0104655 A1 8/2002 Hurst et al.
2002/0129111 A1 9/2002 Cooper
2002/0138581 A1 9/2002 MacIntosh et al.
2003/0014490 A1 1/2003 Bates et al.
2003/0029614 A1 2/2003 Michel
2003/0097412 A1 5/2003 Chow
2003/0111224 A1 6/2003 Hailey, Jr. et al.
2003/0115280 A1 6/2003 Quine et al.
2004/0020832 A1 2/2004 Richards et al.
2004/0073619 A1 4/2004 Gilhuly et al.
2004/0140089 A1 7/2004 Gunneroed
2005/0072576 A1 4/2005 Henriksen et al.
2005/0082060 A1 4/2005 Ward et al.
2006/0041392 A1 2/2006 Korske
2006/0042798 A1 3/2006 Badalamenti et al.
2006/0073986 A1 4/2006 Jones et al.
2006/0237197 A1 10/2006 Dale et al.
2007/0044962 A1 3/2007 Tibbles
2007/0246213 A1 10/2007 Hailey
2008/0035330 A1 2/2008 Richards
2008/0142227 A1 6/2008 Yeh et al.
2008/0283238 A1 11/2008 Richards et al.
2008/0314589 A1 12/2008 Guignard et al.
2009/0008078 A1 1/2009 Patel
2009/0101354 A1 4/2009 Holmes et al.
2009/0140133 A1 6/2009 Abney
2009/0151025 A1 6/2009 Evans
2009/0151925 A1 6/2009 Richards et al.
2009/0173390 A1 7/2009 Slupphaug et al.
2009/0173490 A1 * 7/2009 Dusterhoft ..... E21B 43/082 166/229
2009/0301729 A1 12/2009 Makogon et al.
2010/0032158 A1 2/2010 Dale et al.
2010/0051262 A1 3/2010 Dusterhoft et al.
2010/0059232 A1 * 3/2010 Langlais ..... E21B 17/02 166/380
2010/0258300 A1 10/2010 Shoemate
2011/0011586 A1 1/2011 Dusterhoft et al.
2011/0073308 A1 3/2011 Assal et al.
2011/0094742 A1 4/2011 Badalamenti et al.
2011/0132616 A1 * 6/2011 Yeh ..... E21B 17/02 166/369
2011/0139465 A1 6/2011 Tibbles et al.
2011/0192607 A1 8/2011 Hofman et al.
2011/0198097 A1 8/2011 Moen
2011/0203793 A1 8/2011 Tibbles
2011/0239754 A1 10/2011 Dyer et al.
2011/0247813 A1 10/2011 Moen
2011/0303420 A1 12/2011 Thorkildsen et al.
2012/0000653 A1 1/2012 Panga et al.
2012/0067588 A1 3/2012 Awid et al.
2012/0305243 A1 12/2012 Hallundb et al.
2013/0014953 A1 1/2013 Van Petegem
2013/0037974 A1 2/2013 Nishikawa et al.
2013/0081800 A1 4/2013 Riisem et al.
2013/0092394 A1 4/2013 Holderman et al.
2013/0139465 A1 6/2013 Kuryk et al.
2013/0228341 A1 9/2013 Fripp
2013/0319664 A1 12/2013 McNamee et al.
2014/0014357 A1 1/2014 Riisem
2014/0076580 A1 * 3/2014 Holderman ..... E21B 43/04 166/380
2015/0027700 A1 1/2015 Riisem et al.
2015/0198016 A1 7/2015 Langlais
2015/0308238 A1 10/2015 Langlais
2015/0308239 A1 10/2015 Langlais et al.
2015/0368999 A1 12/2015 de Campos et al.
2016/0215595 A1 7/2016 Lopez et al.
2017/0342809 A1 11/2017 Huh et al.
2018/0023350 A1 1/2018 Lebedeva et al.

FOREIGN PATENT DOCUMENTS

WO 2013/009773 A1 1/2013
WO 2013187878 A1 12/2013
WO 2014/046799 A1 3/2014
WO 2014126587 A1 8/2014

OTHER PUBLICATIONS

Written Opinion for corresponding Singapore Application Serial No. 11201600444P, dated Oct. 25, 2016, 5 pages.
European Search Report for corresponding EP Application Serial No. 14830047.8, dated Feb. 20, 2017, 4 pages.
European Examination Report for corresponding EP Application Serial No. 14830047.8, dated Jun. 12, 2017, 5 pages.
Australian Examination Report for corresponding AU Application Serial No. 2014293014, dated Jul. 11, 2017, 4 pages.
European Examination Report for corresponding EP Application Serial No. 14830047.8, dated Mar. 9, 2018, 5 pages.
Leak-Off Tube Constructed of Sintered Mesh, Published Apr. 4, 2011 on IP.com, publication identifier IPCOM000205879D. http://priorartdatabase.com/pubView/IPCOM000205879D.
Aviles, et al., "Degradable Frac Ball Holds Solution to Persistent Problem in Fracturing", Journal of Petroleum Technology; Society of Petroleum Engineers, Nov. 2013, pp. 32-33.

(56) References Cited

OTHER PUBLICATIONS

Schlumberger, "Elemental Degradable Technology", [http://www.slb.com/services/completions/completion_products/multistage stimulation_systems/elementals.aspx], 2013, 3 pages.
Schlumberger, "Elemental Degradable Technolgy Frac Balls", [slb.com/elemental], 2013, 2 pages.
Flow Conditioners of different mixer types downloaded from [http://www.stamixco-usa.com/plug-flowreactors], on Nov. 23, 2018, 3 pages.
Brasien, B. J. et al., "Experimental investigation of terrain slugging formation, evolution and potential for mitigation", 16th International Conference on Multiphase Production Technology, 2013, BHR Group., pp. 399-414.
Theuveny, B. C. et al., "Integrated Approach to Simulation of Near-Wellbore and Wellbore Cleanup", SPE 166509, 2013 SPE Annual Technical Conference and Exhibition, New Orleans, Louisiana, U.S.A., pp. 1-28.

* cited by examiner

SAND CONTROL SYSTEM AND METHODOLOGY

CROSS-REFERENCE TO RELATED APPLICATIONS

The present document is based on and claims priority to U.S. Provisional Application Ser. No.: 61/858,405 filed Jul. 25, 2013, and to U.S. Provisional Application Ser. No.: 61/985,289 filed Apr. 28, 2014, both of which are incorporated herein by reference.

BACKGROUND

Hydrocarbon fluids such as oil and natural gas are obtained from a subterranean geologic formation, referred to as a reservoir, by drilling a well that penetrates the hydrocarbon-bearing formation. Once a wellbore is drilled, various forms of well completion components, including production tubing, may be installed in the well. In certain applications, inflow control devices are employed to create flow restrictions through the production tubing. The fluid flow in the annulus between the production tubing (or screens) and the wellbore also may be restricted. As a result, the production inflow to the production tubing tends to be more distributed over the length of the production string instead of being concentrated in highly permeable zones or at the top of the production string.

Additionally, gravel packing may be used as a sand control method. A gravel packing operation is performed by mixing gravel with a carrier fluid which is then pumped down the wellbore annulus. The gravel is left in the wellbore annulus to protect the screens, while the carrier fluid flows inwardly through the screens and is routed to the surface. Sometimes, bypass channels are provided to facilitate flow in cases when the wellbore becomes blocked during placement of gravel via the gravel packing operation.

SUMMARY

In general, a system and methodology are provided for facilitating a well operation. At least one dehydration tube is located along an exterior of filter media of a plurality of screen assemblies deployed in a wellbore. The at least one dehydration tube is fluidly coupled to a base pipe of at least one of the screen assemblies via a base pipe opening. Fluid flow along the at least one dehydration tube and/or into the base pipe is controlled with a flow control mechanism. Additionally, an inflow of fluid from an exterior to an interior of select screen assemblies is separately controlled with an inflow control device associated with each select screen assembly.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology for facilitating a well operation, such as a sand control operation employing a gravel pack downhole in a wellbore. In an embodiment, at least one screen assembly and often a plurality of screen assemblies is deployed downhole and at least one dehydration tube is located along an exterior of filter media associated with the screen assemblies. The at least one dehydration tube has an outlet which is in fluid communication with a base pipe of at least one of the screen assemblies via a base pipe opening. During and after a gravel packing operation, for example, fluid flow along the at least one dehydration tube is controlled with a flow control mechanism. Additionally, an inflow of fluid from an exterior to an interior of select screen assemblies is separately controlled with an inflow control device associated with each select screen assembly.

In some embodiments, a sand control system is provided with the screen assembly or a plurality of screen assemblies which are connected together to form a tubing or pipe string that is disposed in the wellbore of a well. The screen assemblies may include inflow control devices (ICDs) to restrict flow from the exterior of the well screen assemblies into the interior of the well screen assemblies. Attached to the outside of the screen assemblies is a dehydration tube that may extend along the length of the screen assemblies. The dehydration tube includes openings that are sized to filter out particles larger than a predetermined size. The openings may be perforations or slits that are sized to filter gravel, e.g. sand, used in gravel packing a well. Gravel packing is used to place gravel in an annulus surrounding the screen assemblies between the exterior of the screen assemblies and the wellbore wall.

A sand control method may be performed by mixing gravel with a carrier fluid to form a gravel slurry. Gravel slurry is pumped downhole and into the wellbore annulus surrounding the screen assemblies. Gravel from the gravel slurry is deposited in this wellbore annulus, and the carrier fluid is removed from the annulus by pulling at least a portion of the carrier fluid into the interior of the screen assemblies and back to the well surface. The dehydration tube filters the gravel slurry and provides a dehydration flow path for the carrier fluid from the exterior of the filter media associated with the screen assemblies to an interior of the screen assemblies.

Figure 1:
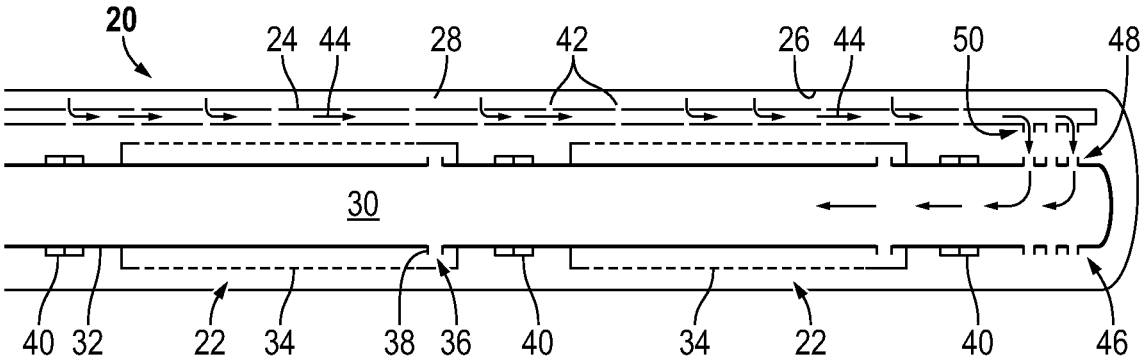
FIG. 1 is a schematic illustration of an example of a well system deployed in a wellbore and comprising at least one screen assembly in combination with a dehydration tube, according to an embodiment of the disclosure.

Referring generally to FIG. 1, an embodiment of a sand control system and a method for use in a well are disclosed. In this embodiment, a sand control system 20 comprises a plurality of screen assemblies 22 and a dehydration tube 24 disposed in a wellbore 26 of a well. A sand control or gravel packing method is used to place gravel in in a wellbore annulus 28 located between the exterior of the screen assemblies 22 and the surrounding wall defining wellbore 26. A sand control method may be performed by mixing gravel with a carrier fluid to form a gravel slurry. The gravel slurry is pumped downhole and into the annulus 28. Gravel from the gravel slurry is deposited in the annulus 28 and the carrier fluid of the gravel slurry is removed from the annulus 28 by flowing at least a portion of the carrier fluid into an interior 30 of screen assemblies 22 and back to a well surface. The dehydration tube 24 is used to filter the gravel slurry and provides a dehydration flow path for the carrier fluid from the annulus 28 along the exterior of the screen assemblies 22 to the interior 30 of the screen assemblies.

As further illustrated in FIG. 1, each screen assembly 22 may comprise a section of a base pipe 32, a filter media 34, and a base pipe port 36. The base pipe port 36 extends radially through the wall forming base pipe 32, i.e. from an exterior to an interior of the wall forming base pipe 32. An inflow control device 38 is disposed at the base pipe port 36. The inflow control device 38 may be a nozzle-based inflow control device 38 having a cross-sectional nozzle flow area of, for example, 2-15 $mm^2$. Other embodiments, however, may have different cross-sectional nozzle flow areas. Additionally, other types of inflow control devices 38 may include a labyrinth or a tortuous flow path extending radially from an exterior to an interior of the wall forming base pipe 32. The inflow control device 38 is in fluid communication with the interior 30, and it may be directly connected to the base pipe 32, e.g. by threadably engaging the ICD with a hole in the base pipe wall, or spaced apart from the base pipe 32 but positioned in the flow path to the interior 30.

In some embodiments, a single screen assembly 22 may be employed, but the illustrated embodiment comprises a plurality of screen assemblies 22 and each screen assembly 22 has filter media 34 to filter particulates out of fluid entering from the exterior of the screen assembly 22 to the interior 30 of the screen assembly 22. The filter media 34 may be, for example, a wire wrap media, a mesh screen media, a perforated pipe, or another suitable filter media. If the filter media 34 is a wire wrap, the wire wrap may comprise a direct wire wrap or a jacket. The filter media 34 also may be in the form of a tube or other enclosure having permeable portions for filtration and non-permeable portions overlaying the base pipe 32. The permeable portions of the filter media 34 may be wire wrap, mesh, or other suitable types of filter media. In this type of embodiment, the inflow control devices 38 may be positioned beneath the overlying non-permeable portion of the filter media 34. In the example illustrated, the screen assemblies 22 are coupled together end-to-end with base pipe connectors 40. The base pipe connectors 40 are located at the ends of each screen assembly 22. Depending on the embodiment, the base pipe connectors 40 may comprise conventional connectors used in connecting sections of base pipe 32 or other suitable connectors.

The dehydration tube 24 includes openings 42 which may be in the form of perforations, slots, or other suitable openings. The openings 42 extend through the outer wall of the dehydration tube 24 and are sized to filter particles so as to allow carrier fluid of the gravel slurry to enter into the interior of the dehydration tube 24. In the example illustrated, the dehydration tube 24 extends along the length of the plurality of screen assemblies 22. However, the dehydration tube 24 may be constructed to extend over portions of that length, or the dehydration tube 24 may be constructed as a plurality of separate dehydration tubes.

In some embodiments, the dehydration tube 24 forms a dehydration tube flow path 44 which extends continuously along the screen assemblies 22. The dehydration tube 24 is disposed in the annulus 28 which may be located in either an open hole wellbore or cased hole wellbore. Gravel slurry carrier fluid flows from the annulus 28, into the dehydration tube 24, and along the dehydration tube flow path 44. In this example, the dehydration tube flow path 44 is routed along the exterior of the plurality of screen assemblies 22. As used herein, placement of the dehydration tube 24 and the dehydration flow path along the exterior of the screen assemblies refers to placement of the dehydration tube 24 and the dehydration flow path along the exterior of filter media 34 of the screen assemblies 22. In some embodiments, the dehydration tube or tubes 24 are located externally of the filter media 34 and within a surrounding shroud. Depending on the application, individual screen assemblies or the plurality of screen assemblies 22 may have other components placed inside and/or outside of the dehydration tube(s) 24.

In the embodiment illustrated, the sand control system 20 further comprises a leak-off screen assembly 46 attached to an end of one of the screen assemblies 22, e.g. to an end of the lower or distally located screen assembly 22 or to another suitable screen assembly 22. The leak-off screen assembly 46 may be in the form of a shorter screen assembly relative to screen assemblies 22. The leak-off screen assembly 46 further comprises openings 48, e.g. perforations, which provide relatively unrestricted flow into the interior 30 of base pipe 32. Carrier fluid flowing along the flow path 44 of dehydration tube 24 flows toward the leak-off assembly 46 and exits the dehydration tube 24 through a discharge or outlet 50, e.g. outlet slots or perforations. The filtered carrier fluid flows from discharge 50 and into the base pipe 32 through openings 48 of leak-off screen assembly 46. In the embodiment illustrated, the lower or distal end of the dehydration tube 24 may be closed to block gravel from entering the dehydration tube 24. The openings of discharge 50 may be located adjacent the openings 48 of leak-off screen assembly 46. For example, the openings of discharge 50 may overlie the openings 48. The carrier fluid entering the base pipe 32 through openings 48 is circulated along interior 30 to a surface of the well. In some applications, the leak-off screen assembly 46 also may comprise a suitable inflow control device 38 which may be in the form of a conventional inflow control device, a sliding sleeve, a valve mechanism, or another suitable device for controlling the inflow of fluid, e.g. to selectively block the flow of fluid through openings 48 during a production operation. In some applications, a sliding sleeve, valve mechanism, or other flow blocking device also may be positioned along the dehydration tube 24 so as to block flow through the openings of discharge 50 and to thus isolate the leak-off screen assembly 46.

In another example, the outlet 50 of the dehydration tube 24 is connected directly into the wall of base pipe 32 at, for example, a location below the distal screen assembly 22 to provide an opening and flow path into the interior 30 of base pipe 32. In this type of embodiment, the leak-off screen assembly 46 may be omitted. The carrier fluid simply flows into the dehydration tube 24, moves along the interior of the tube 24, and then flows directly into the interior 30 of the base pipe 32 via the direct connection. A flow control device, such as a sliding sleeve or valve, may be used to selectively block flow into the base pipe 32. Depending on the application, an individual dehydration tube 24 may be constructed to provide flow to interior 30 at each section of base pipe 32 of each screen assembly 22; or the dehydration tube 24 may be constructed to provide flow to interior 30 at selected sections of base pipe 32 of selected screen assemblies 22 such that some screen assemblies 22 are skipped with respect to inflowing fluid from the dehydration tube 24. Similarly, a plurality of dehydration tubes 24 may be used to direct flow to the interior 30 at each screen assembly 22 or at certain, selected screen assemblies 22.

Figure 2:
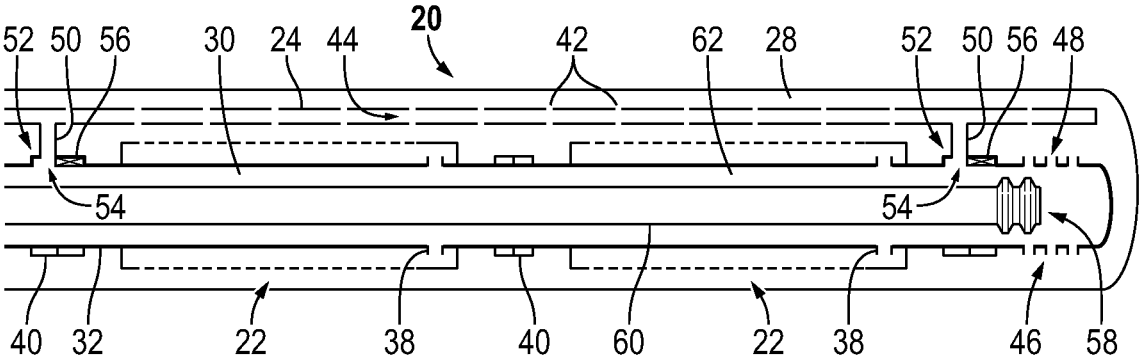
FIG. 2 is a schematic illustration of another example of a screen assembly system, according to an embodiment of the disclosure.

In the embodiment of FIG. 2, for example, the sand control system 20 comprises a valve or a plurality of valves 52 which control flow through the corresponding outlet or outlets 50 between the dehydration tube 24 and the interior 30 of base pipe 32. Each valve 52 provides a separate flow path between the dehydration tube 24 and the interior 30 of base pipe 32. This allows fluid to flow from the dehydration tube 24 into the base pipe 32 without having to travel through the entire dehydration tube 24 to the lower end of the dehydration tube 24 and of sand control system 20. By placing valves 52 at each or several of the screen assemblies 22, the pressure for pumping carrier fluids through the dehydration tube 24 and sand control system 20 is reduced. In other words, the fluid flowing through the dehydration tube 24 has a shorter flow path for entering into the interior 30 of the screen assemblies 22.

Each valve 52 cooperates with a leak-off port or base pipe opening 54 and serves as a flow control mechanism 56 disposed to control flow into base pipe 32 through opening 54. However, valves 52 are just one type of flow control mechanism 56, and mechanism 56 may comprise sliding sleeves, reactive materials, and other devices able to selectively block flow, as discussed in greater detail below. In some applications, the base pipe opening 54 may have a flow area of approximately 300 to 3000 $mm^2$. Similarly, some applications may employ a dehydration tube 24 having a cross-sectional flow area of approximately 300 to 3000 $mm^2$. However, other embodiments of the base pipe opening 54 and dehydration tube 24 may have flow areas of other sizes to accommodate a given application. As with the previously described embodiment, carrier fluid is filtered as it flows into an interior of the dehydration tube 24 and the filtered carrier fluid is delivered to the interior 30 of base pipe 32 through flow control mechanisms 56. For example, each valve 52 may be transitioned between an open position allowing flow into base pipe 32 and a partially or fully closed position which restricts flow into interior 30 of base pipe 32. The valves 52 or other flow control mechanisms 56 may be selectively closed and/or opened by, for example, a shifting tool 58 attached at the end of a tubing 60, e.g. a wash pipe. For example, the shifting tool 58 may be used to close the flow control mechanisms 56 when the wash pipe 60 is retrieved out of the wellbore 26 after a gravel packing operation has been completed in the annulus 28. However, other devices, e.g. coiled tubing, wireline, or other suitable devices, and other intervention techniques may be employed to partially or fully close the flow control mechanisms 56. Additionally, some devices and techniques may be designed to close or begin closing at least some of the flow control mechanisms 56 during the gravel packing operation. In some applications, the flow control mechanism 56 may be positioned at intermediate positions between the closed and open positions. In the example illustrated in FIG. 2, the sand control system 20 also comprises leak-off screen assembly 46 which provides a flow path into interior 30 in addition to base pipe openings 54. However, other embodiments may not use leak-off screen assembly 46. It should be noted that in embodiments described herein fluid flow along the interior of dehydration tubes 24 is directed into the interior 30 of base pipe 32 without flowing through the filter media 34 of screen assemblies 22.

In some applications, the tubing/wash pipe 60 provides a flow path for carrier fluid flowing into base pipe 32. For example, the tubing 60 allows carrier fluid to flow from the base pipe openings 54 into a wash pipe annulus 62 within base pipe 32. The carrier fluid then flows along the exterior of wash pipe 60 until reaching an end of the wash pipe 60 at which point the carrier fluid flows into the interior of the wash pipe 60. The interior of the wash pipe 60 provides a flow path for the carrier fluid and directs the carrier fluid to the surface of the well.

Figure 3:
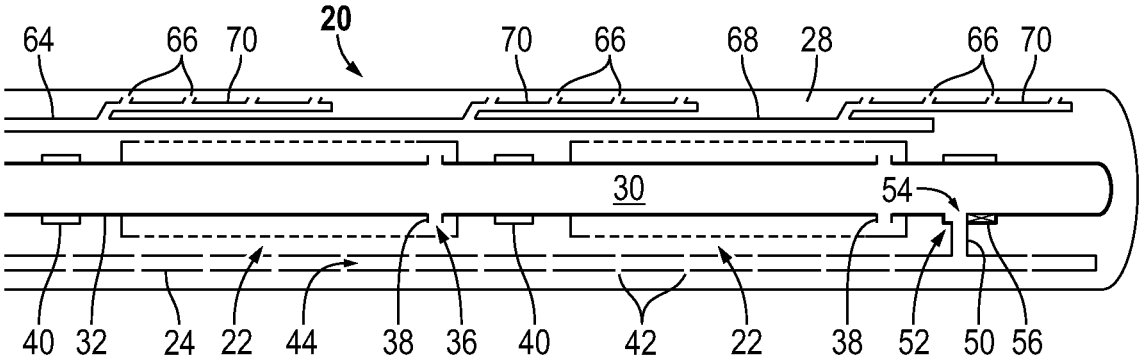
FIG. 3 is a schematic illustration of another example of a screen assembly system, according to an embodiment of the disclosure.
Figure 6:
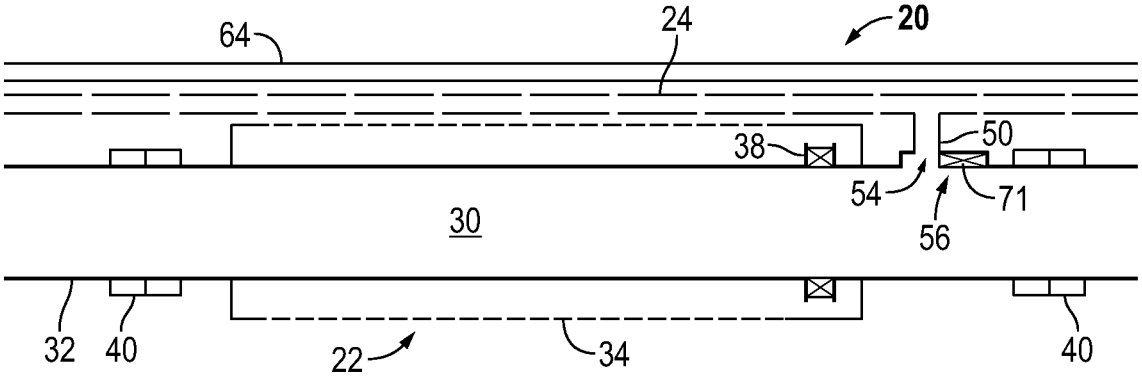
FIG. 6 is a schematic illustration of another example of a screen assembly system in which flow of fluid along a dehydration tube is controllable, according to an embodiment of the disclosure.
Figure 9:
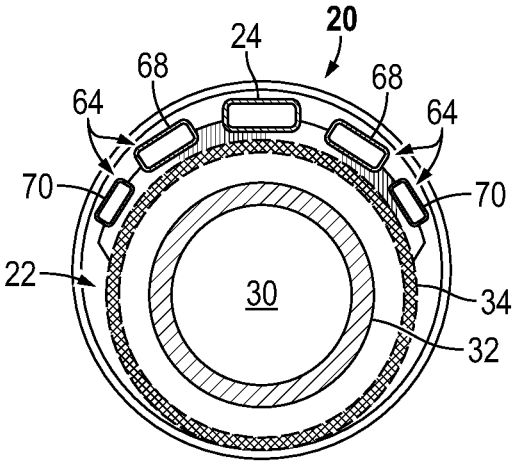
FIG. 9 is a cross-sectional view of another example of the screen assembly system, according to an embodiment of the disclosure.

Referring generally to FIG. 3, another embodiment of sand control system 20 is illustrated. In this embodiment, the sand control system 20 comprises shunt tubes 64. The shunt tubes 64 provide a flow path for gravel slurry during a gravel packing operation. For example, the gravel slurry may be pumped through the shunt tubes 64 and out through a plurality of openings or ports 66 at multiple locations along the annulus 28. In examples illustrated in FIGS. 3, 6 and 9, the shunt tubes 64 are disposed along the exterior of the screen assemblies 22, i.e. along the exterior of the filter media 34 of the screen assemblies 22. The shunt tubes 64 may include transport tubes 68 for transporting gravel slurry and packing tubes 70 which carry openings 66 for directing gravel slurry into the annulus 28. This embodiment also comprises dehydration tube 24 having at least one flow control mechanism 56 which controls flow into interior 30 of base pipe 32. In some applications, the flow control mechanism 56 may comprise a sliding sleeve (e.g. see sliding sleeve 71 in FIG. 6).

Figure 4:
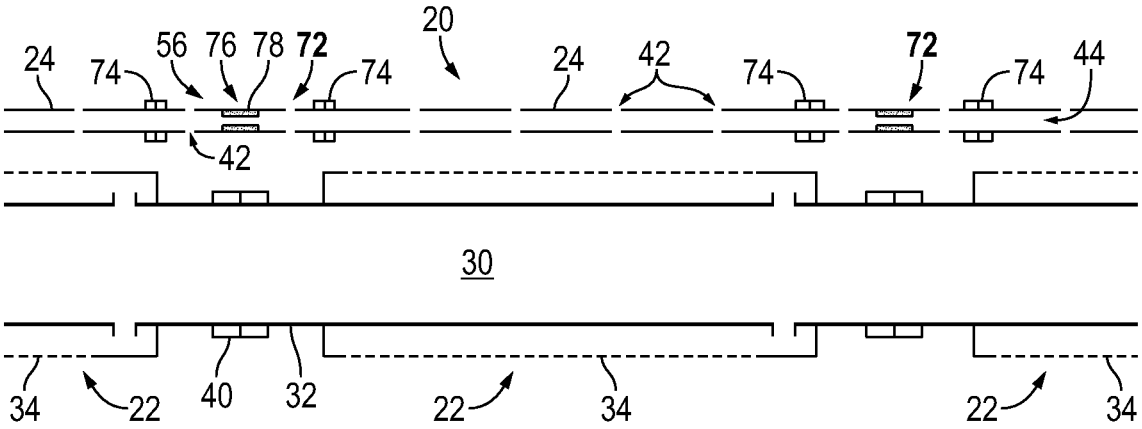
FIG. 4 is a schematic illustration of another example of a screen assembly system, according to an embodiment of the disclosure.
Figure 5:
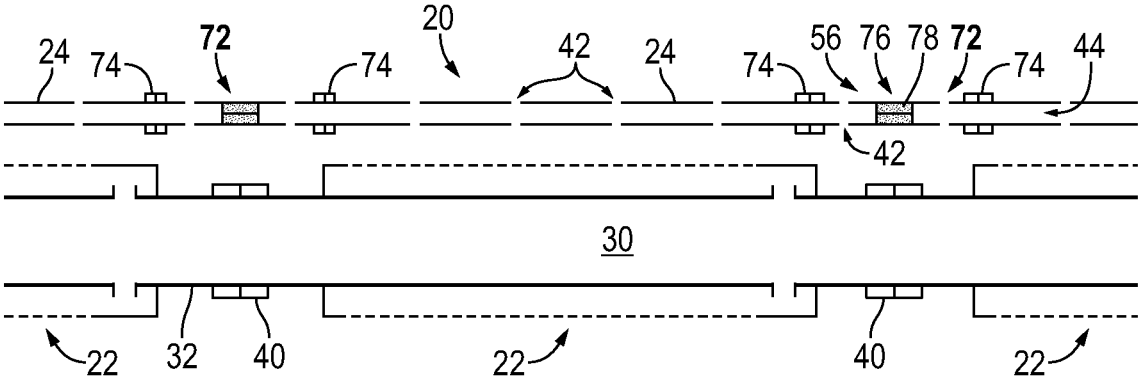
FIG. 5 is a schematic illustration of another example of a screen assembly system, according to an embodiment of the disclosure.

Referring generally to FIG. 4, another embodiment of sand control system 20 is illustrated. In this embodiment, the sand control system 20 further comprises a jumper tube or a plurality of jumper tubes 72. The jumper tubes 72 couple together dehydration tubes 24 associated with sequential screen assemblies 22. The jumper tubes 72 are connected to the ends of adjacent dehydration tubes 24 with connectors 74 to provide a continuous fluid flow connection between the sequential dehydration tubes 24. In some applications, the jumper tubes 72 also may comprise tube openings 42 sized to filter particles of a predetermined size. Examples of this type of embodiment also are illustrated in FIGS. 5, 7 and 8.

In some applications, individual jumper tubes 72 comprise flow control mechanism 56 in the form of a jumper valve 76. The jumper valve 76 has an open position which allows fluid to flow through the jumper tube 72 from one dehydration tube 24 to the next. The jumper valve 76 also has a closed position in which fluid is fully or partially restricted from flowing through the jumper tube 72 from one dehydration tube 24 to the next. In an operational example, the sand control system 20 is run downhole with the jumper valves 76 in the open position. This allows fluid to flow through the sequential dehydration tubes 24. During an/or after performing a gravel pack, the jumper valve or valves 76 can then be shifted to a closed position. In the closed position, fluid flow between sequential dehydration tubes 24 and thus between sequential screen assemblies 22 is restricted. Thus, the jumper valves 76 help prevent cross flow of production fluids between the different screen assemblies 22 by restricting flow through the dehydration tubes 24 following, for example, the gravel packing operation.

Figure 7:
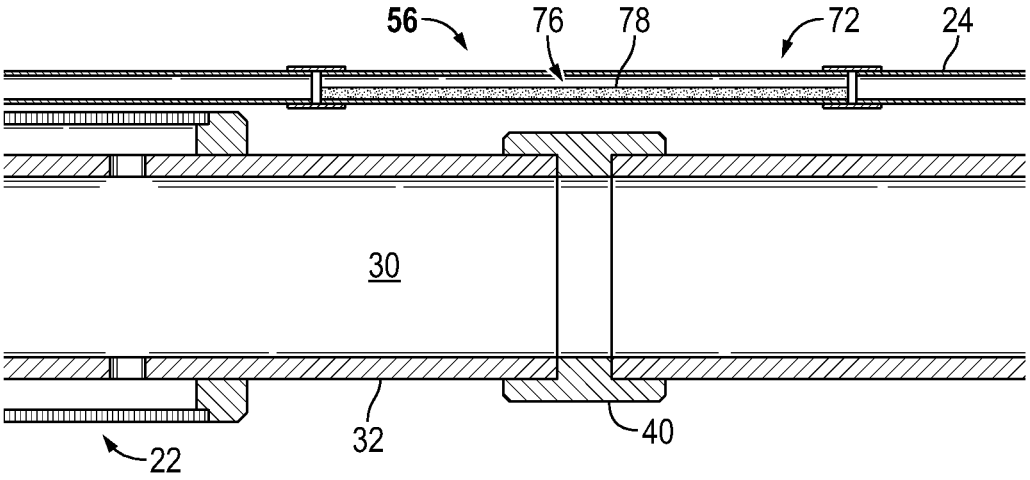
FIG. 7 is a schematic illustration of another example of a screen assembly system in which flow of fluid along a dehydration tube is controllable, according to an embodiment of the disclosure.
Figure 8:
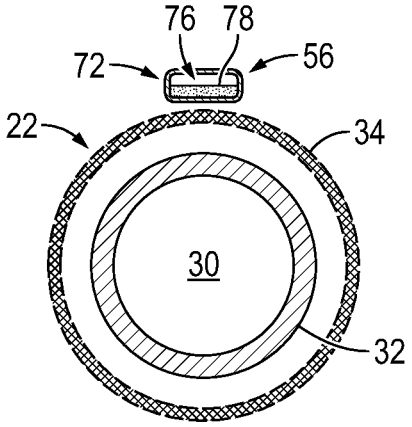
FIG. 8 is a cross-sectional view of the screen assembly system illustrated in FIG. 7, according to an embodiment of the disclosure.

In some applications, the jumper valve 76 may be formed with a reactive material 78 disposed along the interior of the jumper tube 72 (see also FIGS. 7 and 8). For example, the reactive material 78 may be formed along the bottom, sides, and/or center of the jumper tube 72, and/or the reactive material 78 may be disposed at other suitable locations along the dehydration tube(s) 24. The reactive material 78 is illustrated in a non-swelled configuration in FIG. 4 and in a swelled configuration in FIG. 5. The non-swelled configuration allows fluid flow through the jumper valve 76 and between dehydration tubes 24, and the swelled configuration blocks fluid flow through the jumper valve 76. The reactive material 78 may be a swellable elastomer or other suitable material selected so as to swell in reaction to a specific chemical or type of fluid, e.g. well fluid.

Crossflow between screen assemblies 22 also may be limited by separately coupling the plurality of dehydration tubes 24 with the base pipe 32 at corresponding base pipe openings 54. (e.g. see FIGS. 10-12 below). In this type of embodiment, a short distance may be provided between the termination of the dehydration tube 24 into the base pipe opening 54 and the start of the next dehydration tube 24. Such a configuration provides a short interruption between consecutive dehydration tubes 24 and screen assemblies 22 so as to limit crossflow.

In an operational example, sand control system 20 is run in hole from a surface of the well. The sand control system 20 may comprise a gravel packer (not shown) connected to the base pipe 32, thus allowing the sand control system 20 to be fixed in the wellbore 26. A gravel slurry formed of carrier fluid and gravel is then pumped from the surface of the well and down into the wellbore 26. The gravel may comprise sand or other types of proppant and may be pumped through a suitable service tool or tubing. As with conventional gravel packing systems, the gravel slurry flows below the gravel packer and through a crossover to a section of tubing having a gravel flow port. The gravel slurry flows through the gravel flow port and into the annulus 28 along the exterior of the screen assemblies 22. The dehydration tube(s) 24 filter out the gravel and allow the carrier fluid to flow into the interior of the dehydration tube(s) 24 through dehydration tube openings 42. From the interior of the dehydration tubes 24, the carrier fluid is routed into interior 30 of base pipe 32 via base pipe openings 54 which may include leak-off screen opening 48. The carrier fluid freely flows through base pipe openings 54, because the flow control mechanisms 56 are in an open position. A portion of the gravel slurry also may be filtered by filter media 34 before passing into interior 30 through inflow control devices 38.

Carrier fluid flowing into the interior 30 of screen assemblies 22 may then be moved, e.g. pumped, towards the surface of the well. As a result, the gravel slurry is dehydrated and the gravel forms a gravel pack in the annulus 28 adjacent the screen assemblies 22. Because the flow of carrier fluid through the inflow control devices 38 is somewhat restricted, the dehydration tubes 24 help distribute the inflow via dehydration tube openings 42 and base pipe openings 54. The combined flow area of the inflow control devices 38 and the base pipe openings 54 (receiving flow from the dehydration tube or tubes 24) provides a higher flow rate into the interior 30 of the screen assemblies 22 during the gravel pack operation. Consequently, excessive fluid loss to the formation is avoided and chances are reduced with respect to reaching a fracture pressure limit of the formation.

The leak-off screen assembly 46 also may be used to provide an increased flow area into the interior 30 of screen assemblies 22. Other types of openings may further be provided along the screen assemblies 22 and such openings may be sized to provide a desired additional flow area into the interior 30. Upon completion of a gravel packing operation, the flow control mechanisms 56 may be closed to restrict flow into the base pipe 32, e.g. to prevent flow through base pipe openings 54 and through leak-off screen assembly opening 48. In some applications, the flow control mechanisms 56 may comprise the reactive material 78, e.g. swellable material, located in jumper tubes 72 or at other positions along the dehydration tube or tubes 24 to restrict flow after completion of the gravel packing operation.

Following the gravel packing operation, a production operation may be commenced. During the production operation, hydrocarbon fluid from the surrounding reservoir flows into the wellbore 26. The screen assemblies 22 filter sand and other particulates from the hydrocarbon fluid as it moves into interior 30 of the screen assemblies 22 through the inflow control devices 38. The inflow control devices 38 provided a controlled restriction of flow into the interior 30 of base pipe 32. The restriction provided by the inflow control devices 38 helps distribute the flow rate into the different screen assemblies 22 in a controlled manner. The hydrocarbon fluid is then routed upwardly through the interior of the base pipe 32 to a surface of the well.

The flow control mechanisms 56 control the flow from dehydration tube or tubes 24 to the interior 30 of base pipe 32 and they may be constructed in a variety of forms and arranged in a variety of configurations. For example, the flow control mechanisms 56 may comprise sliding sleeves (see FIG. 6), reactive materials 78, valves, e.g. valves 52, or other suitable types of closure mechanisms. Additionally, the flow control mechanisms 56 may be operated mechanically, hydraulically, chemically, e.g. via injection of chemicals, electrically, via timed mechanisms, or through other suitable techniques. In some applications, the flow control mechanisms 56 may comprise check valves operated by applying pressure to the production string. The flow control mechanisms 56 also may comprise sliding sleeves or other mechanisms placed outside of the base pipe 32, along the inside or outside of the dehydration tube(s) 24, or at combined locations along both the base pipe 32 and the dehydration tubes 24. In many of these applications, the flow control mechanism 56 may be operated mechanically from the interior 30 of base pipe 32 by moving a ball, disk, rotating sleeve, or other device.

Figure 10:
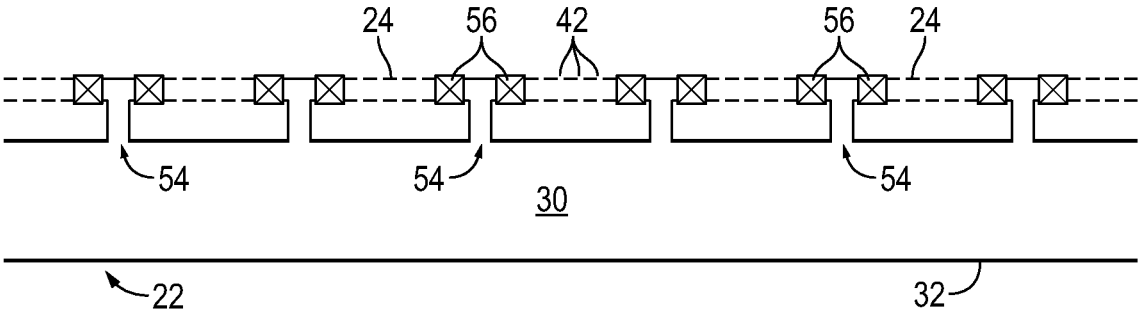
FIG. 10 is a schematic illustration of another example of a screen assembly system in which flow of fluid along a dehydration tube is controllable, according to an embodiment of the disclosure.
Figure 11:
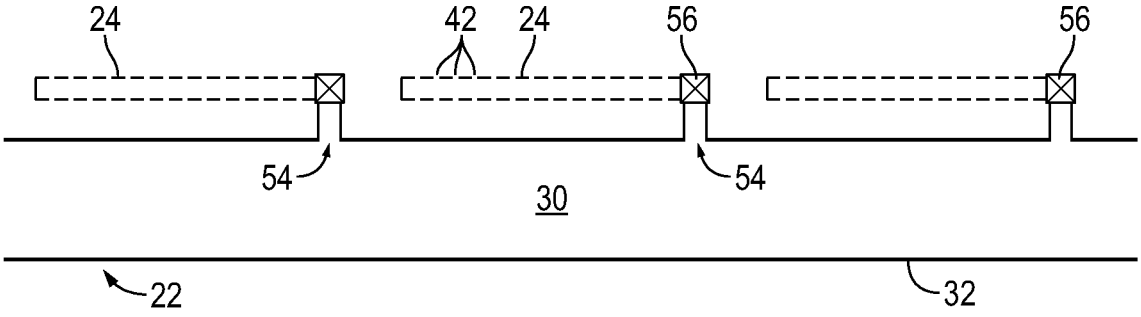
FIG. 11 is a schematic illustration of another example of a screen assembly system in which flow of fluid along a dehydration tube is controllable, according to an embodiment of the disclosure.
Figure 12:
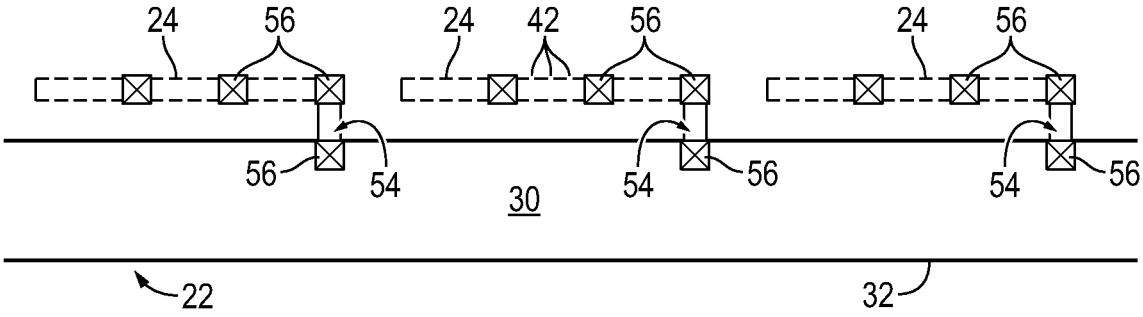
FIG. 12 is a schematic illustration of another example of a screen assembly system in which flow of fluid along a dehydration tube is controllable, according to an embodiment of the disclosure.

As illustrated in FIG. 10, for example, flow control mechanisms 56 may be positioned along dehydration tube 24 on one or both sides of each base pipe opening 54. In other embodiments, a plurality of dehydration tubes 24 may be individually connected with the base pipe 32, as illustrated in FIG. 11. In this embodiment, a flow control mechanism 56 may be positioned in each dehydration tube 24 proximate the base pipe openings 54 to enable selective closure of the base pipe openings 54. In the embodiment illustrated in FIG. 12, a plurality of separate dehydration tubes 24 is again coupled with base pipe 32 at a plurality of base pipe openings 54. However, a plurality of the flow control mechanisms 56 may be located along the length of each dehydration tube 24 and/or along an interior of the base pipe 32 at base pipe opening 54, as illustrated. It should be noted that the embodiments illustrated are examples and that different numbers of dehydration tubes 24 may be used to deliver fluid to the interior of different numbers of screen assemblies 22. In the embodiment illustrated in FIG. 10, for example, a single section of base pipe 32 may be provided with multiple base pipe openings 54. In other embodiments, e.g. FIG. 11, an individual or a plurality of dehydration tubes 24 may be used to deliver fluid to a plurality of sections of base pipe 32 through a base pipe opening 54 in each section of base pipe 32. In other embodiments, e.g. FIG. 12, the system may comprise a plurality of sections of base pipe 32 which work in cooperation with an individual or a plurality of dehydration tubes 24 which are used to deliver fluid through base pipe openings 54 in some but not all of the sections of base pipe 32.

Figure 13:
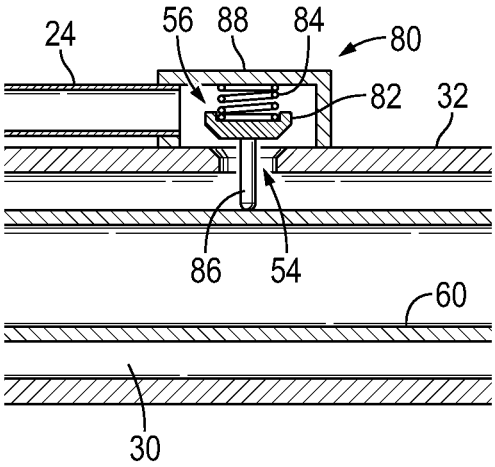
FIG. 13 is a schematic cross-sectional illustration of an example of a flow control mechanism for use with a dehydration tube, according to an embodiment of the disclosure.
Figure 14:
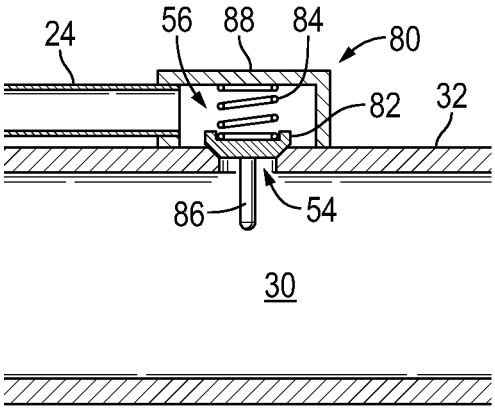
FIG. 14 is a schematic cross-sectional illustration of the flow control mechanism illustrated in FIG. 13 but in a different operational position, according to an embodiment of the disclosure.

Referring generally to FIG. 13, another example of flow control mechanism 56 is illustrated. In this example, flow control mechanism 56 comprises a mechanically actuated valve 80 having a sealing mechanism 82 biased toward a closed, sealing position with respect to base pipe opening 54 via a bias member 84, e.g. a spring member. The sealing mechanism 82 is moved against the bias of bias member 84 and to an open position via a valve structure 86 which interacts with tubing/wash pipe 60. When wash pipe 60 is moved along the interior 30 past valve 80, the wash pipe 60 engages valve structure 86 and moves sealing mechanism 82 against the bias of bias member 84 to open the base pipe opening 54. In some applications, the valve structure 86 may be mounted on wash pipe 60 for engagement with sealing mechanism 82. Regardless of the location of valve structure 86, the actuation of sealing mechanism 82 to an open position allows carrier fluid to flow from dehydration tube 24, into a valve housing 88 containing sealing mechanism 82, and then through base pipe opening 54 to interior 30. As described above, the carrier fluid may then be routed upwardly to the surface through an interior of the wash pipe 60. The bias member 84 automatically shifts sealing mechanism 82 and closes base pipe opening 54 once the wash pipe 60 is withdrawn from the region of base pipe 32 containing valve 80, as illustrated in FIG. 14. Mechanically actuated valves 80 may be placed at each base pipe opening 54, including leak-off screen openings 48.

Figure 15:
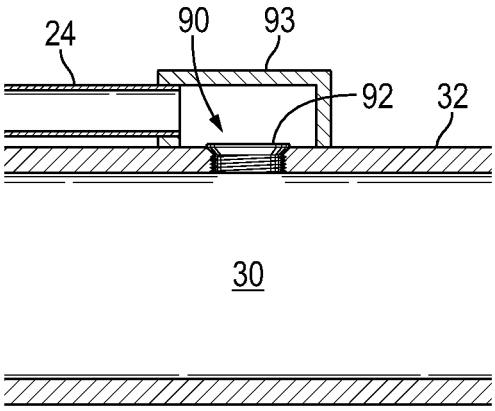
FIG. 15 is a schematic cross-sectional illustration of an example of a filtration mechanism for a dehydration tube, according to an embodiment of the disclosure.

In some embodiments, filtration devices are deployed along the dehydration tube 24. As illustrated in FIG. 15, for example, a filtering media such as filtering device 90 may be placed in the flow path of carrier fluid moving along the dehydration tube 24 to the interior 30 of base pipe 32. In this example, the filtering device 90 comprises a plug 92 fitted into base pipe opening 54. The filtering device 90 is located within a dehydration tube connection housing 93 by which the corresponding dehydration tube 24 is fluidly coupled with base pipe opening 54. If the system comprises a plurality of base pipe openings 54, filter plugs 92 may be placed in each of the base pipe openings 54. The filter plug 92 may be formed from a variety of materials, such as mesh materials, having openings sized to further filter the carrier fluid flowing along the interior of the corresponding dehydration tube 24.

Figure 16:
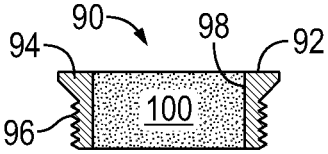
FIG. 16 is a schematic cross-sectional illustration of another example of a filtration mechanism for use with a dehydration tube, according to an embodiment of the disclosure.

In some applications, the filter plug 92 may comprise a filter plug housing 94 having a fastening mechanism 96, e.g. a threaded region, as illustrated in FIG. 16. The filter plug 92 is secured in the corresponding base pipe opening 54 by fastening mechanism 96. In this example, the filter plug housing 94 has an open interior 98 through which fluid may flow into interior 30. The open interior 98 is filled with a filtering material, such as a mesh material 100.

Figure 17:
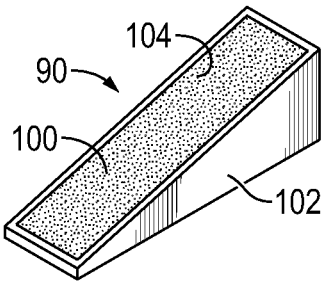
FIG. 17 is a schematic orthogonal illustration of an example of another filtration mechanism for use with a dehydration tube, according to an embodiment of the disclosure.

As illustrated in FIG. 17, the filtering device 90 also may be constructed for insertion directly within the dehydration tube 24 or within the connection housing 93. In this example, the filtering device 90 comprises a housing structure 102 sized and shaped for insertion into the interior of a corresponding dehydration tube 24 or connection housing 93. As illustrated, the housing structure 102 may be angled or otherwise shaped to fit within connection housing 93 and to provide an opening 104 into which the carrier fluid can flow as it is directed into base pipe opening 54. The opening 104 may again be filled with a suitable filtering material, such as mesh material 100.

Figure 18:
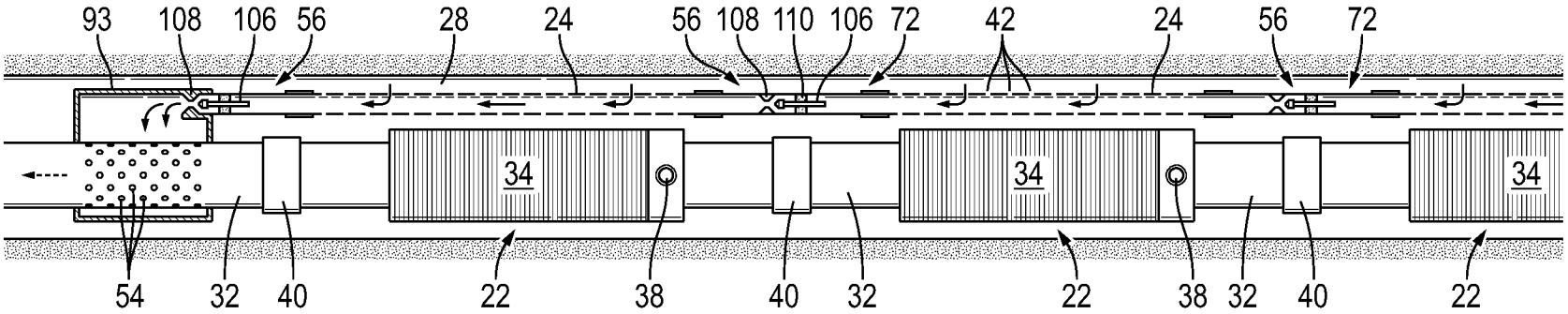
FIG. 18 is a schematic illustration of another example of a screen assembly system, according to an embodiment of the disclosure.

Referring generally to FIG. 18, another example of sand control system 20 is illustrated. In this embodiment, flow control mechanisms 56 are disposed along dehydration tube 24. For example, flow control mechanisms 56 may be disposed in jumper tubes 72 used to couple sequential dehydration tubes 24. However, the flow control mechanisms 56 also may be positioned proximate one or more base pipe openings 54 located along the wall of base pipe 32. In this embodiment, the flow control mechanisms 56 may comprise a spring-loaded plunger 106 biased toward sealing engagement with a corresponding seat 108. The spring-loaded plunger 106 may be initially held in an open position by a degradable member 110 formed of a degradable material. The degradable material of member 110 is selected to degrade in the presence of a specific fluid, e.g. a well fluid or a chemical delivered downhole. Upon sufficient degradation of member 110, the spring-loaded plunger 106 is released and moved against corresponding seat 108 to block flow along the dehydration tube 24 and/or into the interior 30 of base pipe 32. However, the flow control mechanism 56/spring-loaded plunger 106 may be controlled by a variety of other devices, such as a wash pipe which holds the flow control mechanism 56 in an open position during gravel packing.

The sand control system 20 may be used in a variety of applications, including numerous types of well production applications. Depending on the specifics of a given well application and environment, the construction of the overall system 20, screen assemblies 22, dehydration tubes 24, shunt tubes 64, and filtering techniques/media may vary. Additionally, the system may be designed for use in many types of wells, including vertical wells and deviated, e.g. horizontal, wells. The wells may be drilled in a variety of formations with single or multiple production zones and with many types of gravel packs.

Depending on the application, many types of devices for controlling flow also may be employed in the overall system 20. For example, a variety of inflow control devices 38 may be constructed and positioned to control flow from the annulus 28 to the interior 30 of base pipe 32. Additionally, many types of flow control mechanisms 56 may be used to control flow of carrier fluid along the dehydration tube or tubes 24 and/or to control flow from the dehydration tube(s) 24 into the interior 30 of base pipe 32. A variety of valves, sliding sleeves, reactive materials, e.g. swellable rubbers and other swellable materials, degradable materials, and other devices may be used alone or in combination as flow control mechanisms 56.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a well, comprising:

a sand control system having a base pipe and a screen assembly sized for deployment in a wellbore, the screen assembly comprising:

a filter media configured to filter a gravel slurry flowing through an annulus between the screen assembly and the wellbore; and an inflow control device positioned to control inflow of gravel packing carrier fluid to an interior of the base pipe after filtering of the gravel packing carrier fluid from the gravel slurry via the filter media; and a dehydration system having a dehydration tube extending axially along the screen assembly radially external to the screen assembly, the dehydration tube having a plurality of openings sized to filter gravel of the gravel slurry from inflowing gravel packing carrier fluid of the gravel slurry, the dehydration tube being in fluid communication with the interior of the base pipe independently of the screen assembly, wherein the dehydration system further comprises an outlet operatively engaged with the base pipe at a base pipe opening to direct the gravel packing carrier fluid from an interior of the dehydration tube to an interior of the base pipe, wherein the dehydration system further comprises a flow control mechanism provided along a first flow path of the dehydration tube, the flow control mechanism configured to control flow of production fluid into the interior of the base pipe, and wherein the dehydration system directs fluid flow to the interior of the base pipe via a leak-off screen assembly, the leak-off screen assembly comprising a plurality of perforations that provide at least partially unrestricted flow along a second fluid path into the interior of the base pipe.

2. The system as recited in claim 1, wherein the sand control system comprises a plurality of screen assemblies.

3. The system as recited in claim 2, wherein dehydration tubes of adjacent screen assemblies are connected via jumper tubes.

4. The system as recited in claim 1, wherein the flow control mechanism comprises a sliding sleeve.

5. The system as recited in claim 1, wherein the flow control mechanism comprises a swellable material.

6. The system as recited in claim 1, wherein the flow control mechanism comprises a valve.

7. The system as recited in claim 1, wherein the flow control mechanism comprises a spring biased plug.

8. The system as recited in claim 1, wherein the dehydration system further comprises a filter placed along a flow path extending through the interior of the dehydration tube to the interior of the base pipe.

9. The system as recited in claim 1, wherein the dehydration system further comprises a plurality of separate dehydration tubes.

10. The system as recited in claim 9, further comprising a plurality of flow control mechanisms deployed along the dehydration tubes to control flow through individual base pipe openings.

11. The system as recited in claim 1, wherein the dehydration tube is in fluid communication with the interior of the base pipe via a plurality of base pipe openings.

12. A method for use in a well, comprising:

pumping a gravel slurry via at least one transport tube into a wellbore and via at least one packing tube to an annulus surrounding a sand control system having a dehydration tube positioned externally of filter media associated with a plurality of sand control assemblies;

using the dehydration tube to separate gravel from a carrier fluid of the gravel slurry and to direct the carrier fluid along a first flow path routed through an interior of the dehydration tube and to an interior of a base pipe of at least one sand control assembly of the plurality of sand control assemblies, wherein the dehydration tube directs the carrier fluid along the first flow path from the interior of the dehydration tube to the interior of the base pipe via an outlet operatively engaged with the base pipe at a base pipe opening;

providing a flow control mechanism along the first flow path of the dehydration tube;

providing a leak-off screen assembly attached to an end of the at least one sand control assembly, the leak-off screen assembly comprising a plurality of perforations that provide at least partially unrestricted flow along a second flow path into the interior of the base pipe;

using the filter media to separate gravel from the carrier fluid of the gravel slurry; and employing an inflow control device to control a flow of the carrier fluid from the annulus surrounding the sand control system through the filter media to the interior of the base pipe separately from the first and second flow paths through the interior of the dehydration tube and to the interior of the base pipe.

13. The method as recited in claim 12, wherein providing the flow control mechanism comprises providing a plurality of flow control mechanisms along the dehydration tube.

14. The method as recited in claim 12, further comprising providing fluid communication between the dehydration tube and the interior of the base pipe via a plurality of base pipe openings disposed along base pipes of the plurality of sand control assemblies.

15. The method as recited in claim 12, wherein using comprises using a plurality of separate dehydration tubes coupled to the base pipe at a plurality of base pipe openings.

16. The method as recited in claim 12, further comprising actuating the flow control mechanism to control inflow of fluid to the interior of the base pipe.

17. The method as recited in claim 12, wherein providing the flow control mechanism comprises providing a valve; and further comprising actuating the valve.

18. The method as recited in claim 12, wherein providing the flow control mechanism comprises providing a swellable material in the dehydration tube.

19. The method as recited in claim 12, wherein providing the flow control mechanism comprises using a wash pipe to temporarily hold open a valve.

20. A method, comprising:

locating at least one dehydration tube along an exterior of filter media of a plurality of screen assemblies;

fluidly coupling the at least one dehydration tube to a base pipe of a selected screen assembly via a base pipe opening of the selected screen assembly;

pumping a gravel slurry into an annulus at least partially between the at least one dehydration tube and the plurality of screen assemblies;

filtering gravel of the gravel slurry from an inflowing carrier fluid of the gravel slurry into the dehydration tube, wherein the dehydration tube directs the inflowing carrier fluid along a first flow path from an interior of the dehydration tube to an interior of the base pipe via an outlet operatively engaged with the base pipe at the base pipe opening;

filtering gravel of the gravel slurry from the inflowing carrier fluid of the gravel slurry using the filter media of the plurality of screen assemblies;

controlling a flow of the carrier fluid along the first flow path of the at least one dehydration tube with a flow control mechanism, wherein a leak-off screen assembly is attached to an end of the selected screen assembly, the leak-off screen assembly comprising a plurality of perforations that provide at least partially unrestricted flow along a second fluid path into the interior of the base pipe; and separately controlling inflow of the carrier fluid from the annulus to an interior of certain screen assemblies with corresponding inflow control devices, each inflow control device being placed in communication with the interior through an inflow control device opening of the base pipe separate from the base pipe opening.

21. The method as recited in claim 20, further comprising maintaining the flow control mechanism open during a gravel packing operation and maintaining the flow control mechanism in a closed position after completing the gravel packing operation.

* * * * *